US007638938B2

(12) United States Patent
Aoyama et al.

(10) Patent No.: US 7,638,938 B2
(45) Date of Patent: Dec. 29, 2009

(54) PHOSPHOR ELEMENT AND DISPLAY DEVICE

(75) Inventors: Toshiyuki Aoyama, Settu (JP); Masayuki Ono, Osaka (JP); Shogo Nasu, Kobe (JP); Masaru Odagiri, Kawanishi (JP)

(73) Assignee: Panasonic Corporation, Osaka (JP)

( * ) Notice: Subject to any disclaimer, the term of this patent is extended or adjusted under 35 U.S.C. 154(b) by 649 days.

(21) Appl. No.: 11/253,794

(22) Filed: Oct. 20, 2005

(65) Prior Publication Data

US 2006/0091789 A1 May 4, 2006

(30) Foreign Application Priority Data

Oct. 28, 2004 (JP) ..... 2004-313888

(51) Int. Cl.
*H05B 33/00* (2006.01)

(52) U.S. Cl. ..... 313/503; 313/502

(58) Field of Classification Search ..... None
See application file for complete search history.

(56) References Cited

U.S. PATENT DOCUMENTS

| | | | | |
|---|---|---|---|---|
| 4,152,712 | A * | 5/1979 | Myers | 257/93 |
| 4,937,150 | A | 6/1990 | Tsukada | |
| 6,204,545 | B1 | 3/2001 | Nakata | |
| 7,271,533 | B2 * | 9/2007 | Carter et al. | 313/503 |
| 7,378,151 | B2 | 5/2008 | Sato et al. | |
| 2006/0152138 | A1 * | 7/2006 | Hori et al. | 313/503 |
| 2006/0181197 | A1 * | 8/2006 | Nago et al. | 313/503 |

FOREIGN PATENT DOCUMENTS

| | | | |
|---|---|---|---|
| CN | 2077148 | U | 5/1991 |
| CN | 1194727 | A | 9/1998 |
| JP | 63-066282 | | 3/1988 |
| JP | 07-066450 | | 3/1995 |
| JP | 2002-216968 | | 8/2002 |
| JP | 2002-324671 | | 11/2002 |
| WO | WO 2004/046767 | A2 | 6/2004 |
| WO | WO 2004/056938 | A1 | 7/2004 |

OTHER PUBLICATIONS

Chinese Office Action, with English translation thereof, issued in Patent Application No. 200510118701.6 dated Jul. 11, 2008.

* cited by examiner

*Primary Examiner*—Ashok Patel
(74) *Attorney, Agent, or Firm*—McDermott Will & Emery LLP

(57) ABSTRACT

The phosphor element includes a pair of electrodes facing each other and a phosphor layer containing phosphor particles, the phosphor layer being supported between the pair of electrodes. The phosphor particles include a first semiconductor part and a second semiconductor part which covers at least a part of the surface of the first semiconductor part.

49 Claims, 7 Drawing Sheets

PHOSPHOR ELEMENT AND DISPLAY DEVICE

BACKGROUND

1. Technical Field

The invention relates to a phosphor element used for a surface emitting source, a flat display device and the like, and to a display device using the phosphor element.

2. Description of the Related Art

Light emitting diodes, phosphor elements (referred to as EL elements) and the like, are currently used for light emitting devices used in surface emitting sources and flat display devices. Light emitting diodes are phosphor elements that utilize the phenomenon that light is emitted when electrons injected into a p-type semiconductor from a n-type semiconductor are recombined with holes injected into the n-type semiconductor from the p-type semiconductor in an electric field applied to a p-n junction on the junction plane between the p-type semiconductor and the n-type semiconductor. This light emitting diode is quite worthy of evaluation in the point of high emission and high efficiency. In one example of a method of producing this emitting diode, thin layers are laminated sequentially on a semiconductor substrate by crystal growth, as shown in Japanese Patent Laid-Open Publication No. H07-66450. Here, because the light emitting diode emits light from the p-n junction part, the substrate on which these thin layers are grown is diced to expose the p-n junction part as the end face from the surface, thereby taking out the emitted light outside. Therefore, the light emitting diode is a point source of light. In the case of intending to obtain surface emission by using this light emitting diode, plural light emitting diodes are arranged to attain surface emission.

On the other hand, the EL elements are roughly divided into an organic EL element provided with a phosphor material made of an organic phosphor material to which d.c. voltage is applied to recombine electrons with holes to emit light and an inorganic EL element which is provided with a phosphor material made of an inorganic material to which a.c. voltage is applied to thereby collide electrons accelerated in an electric field as high as $10^6$ V/cm with the emission center of the fluorescent body to excite the inorganic phosphor material, thereby allowing the inorganic phosphor material to emit light when this excitement is relaxed.

Explanations will be furnished as to an EL element called a distributed type EL element among inorganic EL elements. The EL element is structured by laminating a first electrode, a phosphor layer, a dielectric layer and a second electrode in this order on a substrate. The phosphor layer contains inorganic fluorescent particles, such as ZnS and Mn dispersed in an organic binder. The dielectric layer has a structure in which a ferroelectric material such as $BaTiO_3$ is dispersed in an organic binder. An a.c. power source is disposed between the first electrode and the second electrode. Then, a.c. voltage is applied across the first and second electrodes from the a.c. power source to make the EL element emit light. For example, Japanese Patent Laid-open Publication No. 2002-216968 discloses a structure in which the aforementioned EL element is covered with a moisture-proof body. The EL element is scarcely limited by the material of the substrate and for example, a plastic film or glass can be used, which makes it easy to develop a larger area semiconductor by using a single substrate.

SUMMARY

A conventional light emitting diode is, however, a point light source and therefore, it is necessary to arrange plural light emitting diodes two-dimensionally to provide a large area surface emitting source. In this method, however, the number of necessary light emitting diodes increases as much as the area of surface emitting source increases, giving rise to the problem that production cost increases in proportion to the area.

Also, a surface light emitting device using the aforementioned EL element is large-sized without any problem and is collectively superior to other displays also from the viewpoints of the development of a thinner type, high-speed response and wide angle of visibility. However, the surface light emitting device has low phosphor efficacy and low emission and its life is limited, posing a practical problem.

The novel concepts disclosed herein were achieved in order to solve the foregoing problems in the conventional art, and herein is disclosed a phosphor element which has high phosphor efficacy and can be more increased in its area at low costs.

To achieve the foregoing, a phosphor element includes:

a pair of electrodes facing each other; and a phosphor layer containing phosphor particles, the phosphor layer being supported between the pair of electrodes, wherein the phosphor particles include a first semiconductor part and a second semiconductor part which covers at least a part of the surface of the first semiconductor part.

To achieve the foregoing, a phosphor element according to the present invention includes:

a pair of electrodes facing each other; and a phosphor layer containing phosphor particles, the phosphor layer being supported between the pair of electrodes, wherein the phosphor particles include a first semiconductor part as the core, a second semiconductor part as the outermost part of the phosphor particles and a third semiconductor part which is disposed between the first semiconductor part and the second semiconductor part and covers substantially all surface of the first semiconductor part, wherein the band gap energy of the third semiconductor part is lower than the bandgap energy of at least one of the first semiconductor part and the second semiconductor part.

To achieve the foregoing, a display device includes:

a phosphor element array in which plural phosphor elements are arranged two-dimensionally, wherein each phosphor element includes:

a pair of electrodes facing each other; and a phosphor layer containing phosphor particles, the phosphor layer being supported between the pair of electrodes, wherein the phosphor particles include a first semiconductor part and a second semiconductor part which covers at least a part of the surface of the first semiconductor;

plural X electrodes extending each other in parallel in a first direction parallel to the phosphor surface of the phosphor element array; and plural Y electrodes extending in parallel to the phosphor surface of the phosphor element array and in parallel in a second direction perpendicular to the first direction.

As mentioned above, it is possible to realize a phosphor element which has high phosphor efficacy and can be more increased in area at low costs and also provides a display device by using the phosphor element.

BRIEF DESCRIPTION OF THE DRAWINGS

The present invention will become readily understood from the following description of preferred embodiments thereof made with reference to the accompanying drawings, in which like parts are designated by like reference numeral and in which.

DESCRIPTION OF THE PREFERRED EMBODIMENT

Figure 1:
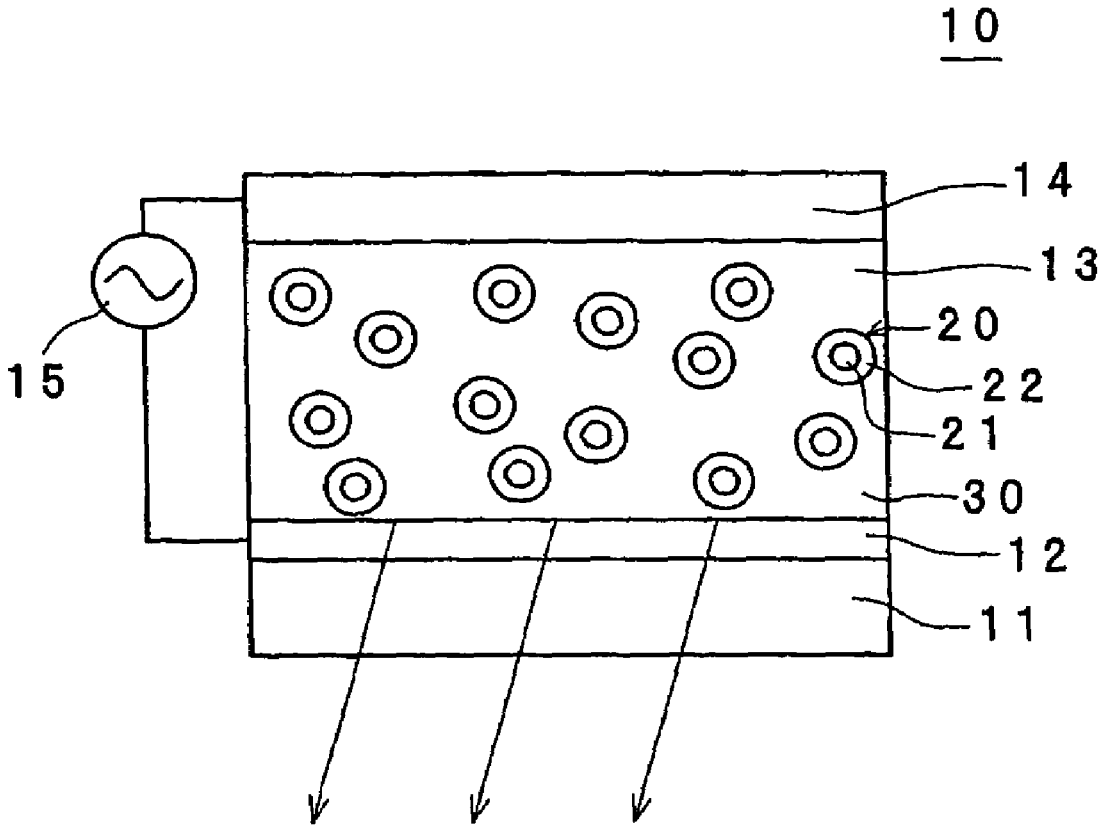
FIG. 1 is a sectional view of a phosphor element according to an embodiment 1 of the present invention.

A light emitting device according to an embodiment of the present invention will be explained with reference to the drawings attached. In the drawings, substantially the same parts are represented by the same symbols.

Embodiment 1

Figure 2:
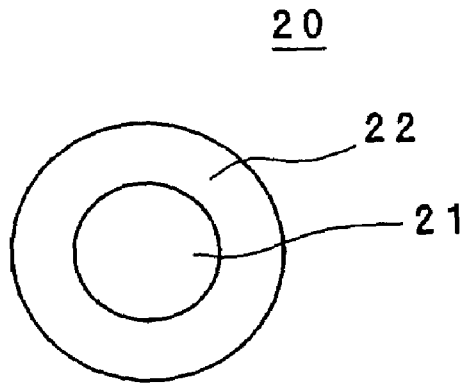
FIG. 2 is a sectional view showing the sectional structure of phosphor particles in a phosphor element according to an embodiment 1 of the present invention.

A light emitting device according to an embodiment 1 in the present invention will be explained with reference to FIG. 1 to FIG. 3. FIG. 1 is a sectional view along the line perpendicular to the light emitting surface of a phosphor element 10 according to the first embodiment 1 of the present invention. This phosphor element 10 has a structure in which a first electrode 12, a phosphor layer 13 and a second electrode 14 are laminated in this order on a substrate 11. An a.c. power source 15 is disposed between the first electrode 12 and the second electrode 14 and a.c. voltage is applied to the phosphor layer 13 to allow the phosphor layer 13 to emit light, which is taken out from the substrate 11 side. The phosphor layer 13 has a structure in which phosphor particles 20 are dispersed in a binder 30. FIG. 2 is a sectional view showing the sectional structure of the phosphor particles 20 contained in the phosphor layer 13. As shown in FIG. 2, the phosphor element 10 has the characteristics that the phosphor layer 13 contains phosphor particles 20 provided with a first semiconductor part 21 and a second semiconductor part 22 that covers the surface of the first semiconductor part 21. Also, the conduction type of the first semiconductor part 21 is preferably different from the conduction type of the second semiconductor part 22. This phosphor element 10 can emit light efficiently because it contains such phosphor particles 20 in the phosphor layer 13.

Each layer constituting this phosphor element 10 will be explained.

First, any material may be used as the substrate 11 insofar as it has light transmittance for the wavelength of the light emitted from the phosphor layer 13. Examples of the material which is used for the substrate 11 and has light transmittance include, though not particularly limited to, a quartz substrate, glass substrate, ceramic substrate and substrates of plastics such as polyethylene terephthalate, polyethylene, polypropylene, polyimide and polyamide.

As the first electrode 12, any material may be applied insofar as it is light transmittable transparent conductor. Examples of the transparent conductor used for the first electrode 12 includes, though not particularly limited to, metal oxides such as ITO ($In_2O_3$ doped with $SnO_2$) and ZnO, thin film metals such as Au, Ag and Al and conductive polymers such as polyaniline, polypyrrole, PEDOT/PSS and polythiophene.

The phosphor layer 13 has a structure in which the phosphor particles 20 are dispersed in the binder 30 made of an organic material. First, the phosphor particles 20 will be explained. As shown in FIG. 2, the phosphor particles 20 are constituted of the first semiconductor part 21 which is to be the core and the second semiconductor part 22 that covers the surface of the first semiconductor part 21. Here, it is only necessary that the first semiconductor part 21 and the second semiconductor part 22 have semiconductor structures having conductive types different from each other. Specifically, when the first semiconductor part 21 has a n-type semiconductor structure, the second semiconductor part 22 has a p-type semiconductor structure, whereas when the first semiconductor part 21 has a p-type semiconductor structure, the second semiconductor part 22 has a n-type semiconductor structure. In this manner, the phosphor particles 20 have a layer structure containing a n-type semiconductor and a p-type semiconductor, whereby electrons collide with holes when an electric field is applied, which makes it possible to obtain highly efficient emission.

Also, the electric resistance of the second semiconductor part 22 is preferably higher than that of the first semiconductor part 21. This is desirable because current is easily flowed from the outside second semiconductor part 22 to the inside first semiconductor part 21, bringing about high phosphor efficacy. If the electric resistance of the second semiconductor part 22 was lower than that of the first semiconductor part 21, current would flow through the outside second semiconductor part 22, namely the surface of the phosphor particles 20, more easily than through the inside first semiconductor part 21, with the result that electrons are not transferred to the inside, leading to decreased phosphor efficacy.

The first and second semiconductor parts 21 and 22 of the phosphor particles 20 preferably take a compound semiconductor structure to obtain efficient emission. The phosphor particles 20 preferably has a structure of semiconductor of, particularly the XIII group-XV group compound or the XII group-XVI group compound. Specifically, the XIII group-XV group compound semiconductors, for example, AlN, AlP, GaN, GaP, GaAs, InN and InP and mixed crystals of these compounds, for example, AlGaN, AlGaP, AlGaAs, GaInN, GaInP, InGaAlN, InGaAlP and InGaAsP or mixtures of these crystals which may be partly segregated are preferable. Also, the XII group-XVI group compound semiconductors, for example, ZnO, ZnS, ZnSe, ZnTe and CdS and mixed crystals of these compounds, for example, ZnCdS, ZnCdSe, ZnCdTe, ZnSSe, ZnCdSSe and ZnCdSeTe or mixtures of these crystals which may be partly segregated are preferable. Moreover, these compound semiconductors may be doped with one or plural impurity elements which are to be donors or acceptors. The dopant is selected from metals and nonmetal elements such as Li, Na, Cu, Ag, Au, Be, Mg, Zn, Cd, B, Al, Ga, In, C, Si, Ge, Sn, Pb, N, P, As, O, S, Se, Te, F, Cl, Br, I, Ti, Cr, Mn, Fe, Co and Ni, rare earth elements such as Ce, Pr, Nd, Sm, Eu, Gd, Tb, Dy, Ho, Er and Tm, fluorides such as $TbF_3$ and $PrF_3$ and oxides such as ZnO and CdO. These compound semiconductors and dopants show examples and are not intended to be limiting of the present invention.

This phosphor particles 20 may be produced, for example, by a vapor phase method. Specifically, in the case of using, for example, gallium nitride is used for the first semiconductor part 21 and a gallium halide and a metal compound for doping or for making a mixed crystal are mixed with ammonia at a temperature of about 850 to 1000° C. in a reaction furnace to react these compounds, thereby obtaining particles made of the first semiconductor part 21. These particles are dispersed by carrier gas in a reaction furnace and dispersed particles, a gallium halide and a metal compound for doping or for making a mixed crystal are mixed with ammonia at a temperature of about 850 to 1000° C. in an atmospheric furnace to react these compounds, thereby generating particles made of the second semiconductor part 22 that covers the first semiconductor part 21 in the same manner as in the case of the first semiconductor part 21. Also, after the reactions for the first and second semiconductor parts 21 and 22 are finished, the generated particles may be annealed at about 600° C. to 1000° C. according to the need. The above process makes it possible to obtain the phosphor particles 20 provided with the first semiconductor part 21 and the second semiconductor part 22 that covers at least a part of the surface of the first semiconductor part 21.

Next, the binder 30 that disperses the phosphor particles 20 in the phosphor layer 13 will be explained. As the binder 30, those in which the phosphor particles 20 can be uniformly dispersed are preferable and also those having high adhesiveness to the upper and lower layers of the phosphor layer 13 are preferable. Also, the binder 30 is preferably a material which is decreased in impurities and foreign matters inducing pinholes and defects and easily provides uniform film thickness and film qualities. Specific examples of the binder material include, though not particularly limited to, polyvinylidene fluoride, a copolymer of vinylidene fluoride and ethylene trifluoride, a ternary copolymer of vinylidene fluoride, ethylene trifluoride and propylene hexafluoride, a copolymer of vinylidene fluoride and ethylene tetrafluoride, vinylidene fluoride oligomer, polyvinyl fluoride (PVF), a copolymer of vinyl fluoride and ethylene trifluoride, polyacrylonitrile, cyanocellulose, a copolymer of vinylidene cyanide and vinyl acetate, polycyanophenylene sulfide, nylon and polyurea.

Also, though the binder 30 may have conductivity, it preferably has an electric resistance larger than the outermost second semiconductor part 22 of the dispersed phosphor particles 20. This reason is that in the case where the electric resistance of the organic binder 30 is lower than the outermost second semiconductor part 22 of the phosphor particles 20 when an electric field is applied to the phosphor layer 13, current is easily flowed through only the organic binder 30 in the phosphor layer 13 and therefore an electric field is applied to the phosphor particles 20 with difficulty, making it difficult for the phosphor particles 20 to emit light. In this embodiment, therefore, the binder 30 is designed to have a higher electric resistance than the second semiconductor part 22. It is to be noted that since the phosphor layer 13 has a structure in which the phosphor particles 20 are dispersed in the organic binder 30, the phosphor layer 13 can be formed by application and it is therefore easy to develop the phosphor layer 13 having a larger area.

Figure 3:
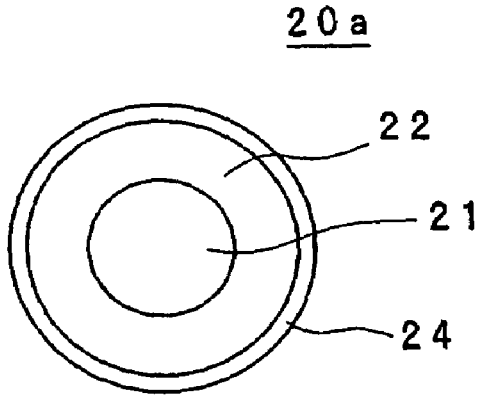
FIG. 3 is a sectional view showing the sectional structure of phosphor particles of another example in a phosphor element according to an embodiment 1 of the present invention.

FIG. 3 is a sectional view showing the sectional structure of phosphor particles 20*a* in another example. This phosphor particles 20*a*, as shown in FIG. 3, has a structure in which a protective layer 24 is covered on substantially all of the outermost surface part. The provision of this protective layer 24 ensures that the phosphor particles 20*a* can prevent external influences such as oxygen and water and therefore oxidation and decomposition can be suppressed.

As the protective layer 24, inorganic compounds such as $Al_2O_3$, AlN and $Y_2O_3$ and organic compounds such as fluororesins may be used. The electric resistance of the protective layer 24 is preferably higher than that of the second semiconductor layer 22 which is covered with the protective layer 24. Current can be thereby made to flow efficiently through the inside of the phosphor particles 20. Also, the electric resistance of the protective layer 24 is preferably lower than that of the binder 30. Current can be thereby made to flow through the inside of the phosphor particles 20 efficiently.

Any material may be used for the second electrode 14 insofar as it is a conductive material. Examples of the conductive material to be used for the second electrode 14 include, though not particularly limited to, metals such as Pt, Al, Au, Ag and Cr or alloys of these metals and transparent conductors. Although the light emitted from the phosphor layer 13 radiates in all directions, light can be taken out only from the substrate 11 side by using a light shading material, for example, a metal having a thickness of about 100 nm or more for the second electrode 14. Moreover, if a highly reflective metal such as Au or Pt is used, the light emitted radiated toward the second electrode side can be reflected toward the substrate 11 side, making it possible to improve phosphor efficacy. Also, when a transparent conductor is used for the second electrode, light can be taken out from both sides, namely the substrate 11 side and the second electrode 14 side, whereby a both-side light emitting phosphor element 10 can be obtained.

The phosphor element may be provided with a cover layer (not shown). Although the cover layer is not essential structural member for light emission, it serves to protect the substrate 11 or the first and second electrodes 12 and 14 or the both. It is necessary for the cover layer to have light transmittance when it is disposed on the side from which the emitted light is taken out. In addition, no particular limitation is imposed on the material and thickness of the cover layer. Also, when the cover layer is disposed on the electrode, it preferably has insulating characteristics.

Examples of the material of the cover layer include, though not limited to, high-molecular materials such as polyethylene terephthalate, polyethylene, polypropylene, polyimide, polyamide and nylon, glass, quarts, ceramics, inorganic oxides and inorganic nitrides.

In this embodiment 1, as mentioned above, the phosphor particles 20 contained in the phosphor layer 13 takes a structure provided with the first semiconductor part 21 which is to be the core and the second semiconductor part 22 that covers substantially all surface of the first semiconductor 21 which makes it possible to obtain a phosphor element 10 which has high phosphor efficacy and can be more increased in area at low costs.

Embodiment 2

Figure 4:
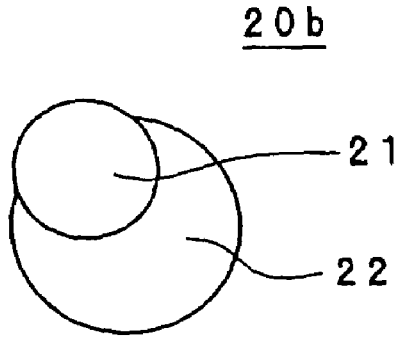
FIG. 4 is a sectional view showing the sectional structure of phosphor particles in a phosphor element according to an embodiment 2 of the present invention.

A phosphor element according to an embodiment 2 of the present invention will be explained using FIGS. 4 and 5. FIG. 4 is a sectional view showing the sectional structure of phosphor particles 20*b* contained in a phosphor layer of the phosphor element. When comparing the phosphor element according to this embodiment with the phosphor element according to the embodiment 1, the sectional structure of the phosphor particles 20*b* is different from that of the phosphor particles 20. As shown in FIG. 4, the phosphor particles 20*b* are constituted of the first semiconductor part 21 which is to be the core and the second semiconductor part 22 that covers a part of the surface of the first semiconductor part 21. Here, it is only necessary that the first semiconductor part 21 and the second semiconductor part 22 have semiconductor structures having conductive types different from each other. Specifically, when the first semiconductor part 21 has a n-type semiconductor structure, the second semiconductor part 22 has a p-type semiconductor structure, whereas when the first semiconductor part 21 has a p-type semiconductor structure, the second semiconductor part 22 has a n-type semiconductor structure. In this manner, the phosphor particles 20*b* have a layer structure containing a n-type semiconductor and a p-type semiconductor, whereby electrons collide with holes when an electric field is applied, which makes it possible to obtain highly efficient emission.

Also, the electric resistance of the second semiconductor part 22 is designed to be higher than that of the first semiconductor part 21 which is to be the core. This is desirable because current is easily flowed from the outside second semiconductor part 22 to the inside first semiconductor part 21, bringing about high phosphor efficacy. If the electric resistance of the second semiconductor part 22 was lower than that of the first semiconductor part 21, current would flow through the outside second semiconductor part 22, namely the outside periphery of the phosphor particles 20*b*, more easily than through the inside first semiconductor part 21, with the result that electrons are scarcely transferred to the inside of the phosphor particles 20*b*, leading to decreased phosphor efficacy.

Figure 5:
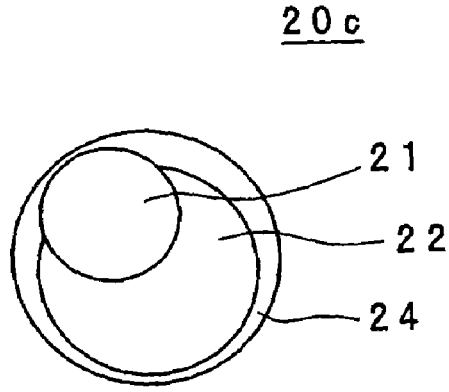
FIG. 5 is a sectional view showing the sectional structure of phosphor particles of another example in a phosphor element according to an embodiment 2 of the present invention.

FIG. 5 is a sectional view showing the sectional structure of phosphor particles 20*c* in another example. This phosphor particles 20*c* may have a structure in which the protective layer 24 is covered on substantially all surface of the outermost surface part as shown in FIG. 5. The provision of the protective layer 24 makes it possible to protect the phosphor particles 20*c* from external influences such as oxygen and water so that oxidation and decomposition can be suppressed. It is to be noted that the electric resistance of the protective layer 24 is preferably higher than that of the covered semiconductor layer. In this embodiment, the protective layer 24 protect both the first semiconductor part 21 and the second semiconductor part 22. It is desirable that the electric resistance of the protective layer 24 be higher than that of each of the first and second semiconductor parts 21 and 22. By this structure, current can be made to flow efficiently through the inside of the phosphor particles 20*c*. Furthermore, the electric resistance of the protective layer 24 is preferably lower than that of the binder 30. This ensures that current can be made to flow through the inside of the phosphor particles 20*c* in an efficient manner.

In this embodiment, as mentioned above, a phosphor element which has high phosphor efficacy and can be more increased in its area at low costs can be obtained in the same manner as in the embodiment 1.

Embodiment 3

Figure 6:
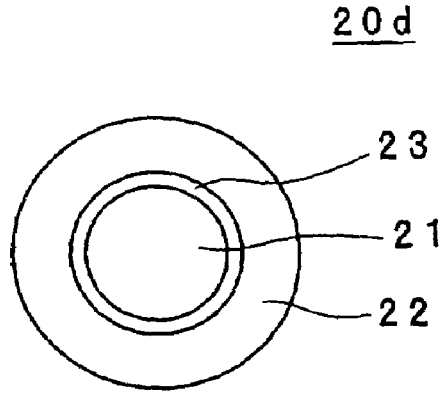
FIG. 6 is a sectional view showing the sectional structure of phosphor particles in a phosphor element according to an embodiment 3 of the present invention.

A phosphor element according to an embodiment 3 of the present invention will be explained using FIGS. 6 and 7. FIG. 6 is a sectional view showing the sectional structure of phosphor particles 20*d* contained in a phosphor layer of the phosphor element. When comparing the phosphor element according to this embodiment with the phosphor element according to the first embodiment 1, the sectional structure of the phosphor particles 20*d* is different from that of the phosphor particles 20. As shown in FIG. 6, the phosphor particles 20*d* are constituted of the first semiconductor part 21 which is to be the core, a third semiconductor part 23 that covers substantially all surface of the first semiconductor part 21 and the second semiconductor 22 that covers substantially all surface of the third semiconductor part 23. The first semiconductor part 21 forms the core part of the phosphor particles 20*d*, the second semiconductor part 22 forms the outermost part of the phosphor particles 20*d* and the third semiconductor part 23 is disposed between the first semiconductor part 21 and the second semiconductor part 22. Here, it is only necessary that the first semiconductor part 21 and the second semiconductor part 22 have semiconductor structures having conductive types different from each other. Specifically, when the first semiconductor part 21 has a n-type semiconductor structure, the second semiconductor part 22 has a p-type semiconductor structure, whereas when the first semiconductor part 21 has a p-type semiconductor structure, the second semiconductor part 22 has a n-type semiconductor structure. It is only necessary that the third semiconductor part 23 be constituted of a material having a bandgap energy lower than either one or both of the bandgap energies of the first and second semiconductor parts 21 and 22. The fundamental structure of the third semiconductor part 23 may be the same as that of the semiconductor part 21 or the second semiconductor 22.

In this manner, the phosphor particles 20*d* have a layer structure containing a n-type semiconductor and a p-type semiconductor and have a low bandgap energy part between the n-type semiconductor and the p-type semiconductor. This structure allows electrons and holes to be accumulated in the low bandgap energy part of the third semiconductor part, whereby electrons collide with holes easily when an electric field is applied, which makes it possible to obtain highly efficient emission.

Figure 7:
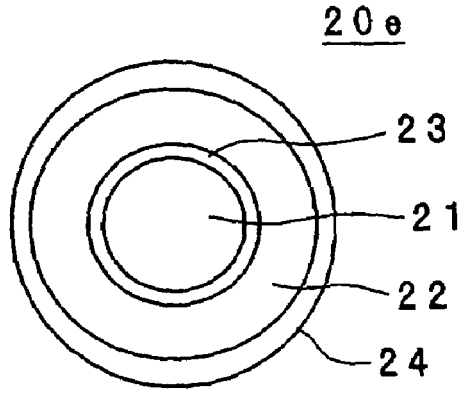
FIG. 7 is a sectional view showing the sectional structure of phosphor particles of another example in a phosphor element according to an embodiment 3 of the present invention.

FIG. 7 is a sectional view showing the sectional structure of phosphor particles 20*e* in another example. This phosphor particles 20*e* may have a structure in which the protective layer 24 is covered on substantially all surface of the outermost surface part as shown in FIG. 7. The provision of the protective layer 24 makes it possible to protect the phosphor particles 20*e* from external influences such as oxygen and water so that oxidation and decomposition can be suppressed. It is to be noted that the electric resistance of the protective layer 24 is preferably higher than that of a covered semiconductor layer. Here, since the protective layer 24 covers the second semiconductor part 22, the electric resistance of the protective layer 24 is preferably higher than that of the second semiconductor part 22. By this structure, current can be made to flow efficiently through the inside of the phosphor particles 20*e*. Furthermore, the electric resistance of the protective layer 24 is preferably lower than that of the binder 30. This ensures that current can be made to flow through the inside of the phosphor particles 20*e* efficiently.

It is to be noted that the phosphor particles are not limited to the phosphor particles 20, 20*a*, 20*b* and 20*c* each having a two-layer structure as shown in the embodiments 1 and 2 and to the phosphor particles 20*d* and 20*e* each having a three-layer structure as shown in the embodiment 3 but may be those having a four- or more-layer structure. In this case, it is only necessary that the phosphor particles are provided with at least one layer of a n-type semiconductor structural part and at least one layer of a p-type semiconductor structural part.

In this embodiment, as mentioned above, a phosphor element which has high phosphor efficacy and can be more increased in its area at low costs can be obtained in the same manner as in the embodiments 1 and 2.

Embodiment 4

Figure 8:
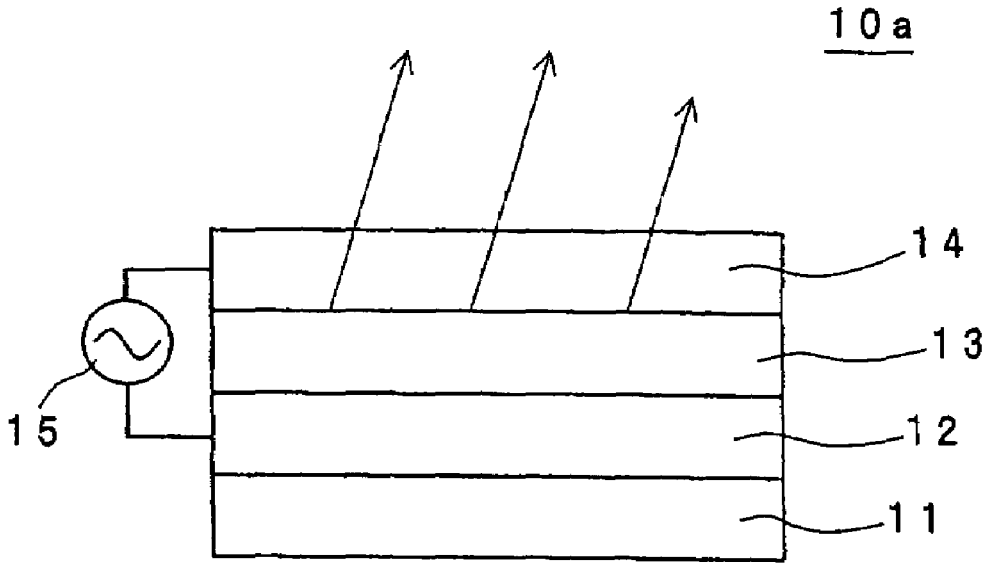
FIG. 8 is a sectional view showing the sectional view of a phosphor element according to an embodiment 4 of the present invention.

FIG. 8 is a sectional view along the line perpendicular to the light emitting surface of the phosphor element 10*a* according to the embodiment 4 of the present invention. When this phosphor element 10*a* is compared with the phosphor element according the embodiment 1, it is different from the phosphor element of the embodiment 1 in the direction in which the light emitted from the phosphor layer 13 is taken out. Therefore, though light transmittable materials are used for the substrate 11 and the first electrode in the embodiment 1, non-light transmittable materials may be used for the substrate 11 and the first electrode 12 in this phosphor element 10*a* while a light transmittable material is used for the second electrode 14. The light from the phosphor layer 13 can be taken out from the second electrode 14 side accordingly.

Next, each layer constituting this phosphor element 10*a* will be explained. Explanations of the same structural members as in the embodiment 1 will be omitted.

First, as the substrate 11, any material may be used regardless of whether it has light transmittance or not without any particular limitation and for example, a ceramic substrate, semiconductor substrate, quartz substrate, glass substrate or plastic substrate may be used. Examples of the ceramic substrate materials used for the substrate 11 include $Al_2O_3$, AlN, $BaTiO_3$ and sapphire. Examples of the semiconductor substrate material include Si, SiC and GaAs. Examples of the plastic substrate material include polyethylene terephthalate, polyethylene, polypropylene, polyimide and polyamide. Also, when light is taken out from the substrate 11 side to make the phosphor element 5 emit light from both sides, it is only required for the substrate 11 to use a light transmittable material in the same manner as in the embodiment 1.

As the first electrode 12, any material may be used insofar as it is a conductive material irrespective of whether it has light transmittance or not without any particular limitation. Examples of the conductive material used for the first electrode 12 include, though not particularly limited, metals such as Pt, Al, Au, Ag and Cr, alloys of these metals and transparent conductors. Although the light emitted from the phosphor layer 13 radiates in all directions, light can be taken out only from the second electrode 14 side by using a light shading material, for example, a metal having a thickness of about 100 nm or more for the first electrode 12. Moreover, if a highly light reflective metal such as Au or Pt is used, the light radiated toward the first electrode side can be reflected toward the second electrode 14 side, making it possible to improve phosphor efficacy. Also, when a light transparent material is used for the first electrode 12, light can be taken out from both sides, namely the second electrode 14 side and the substrate 11 side, whereby a both-side light emitting phosphor element can be obtained.

The phosphor layer 13 may take the same structures as in the above embodiments 1 to 3.

As the second electrode 14, any material may be applied insofar as it is light transmittable transparent conductor. Examples of the transparent conductor used for the second electrode 14 include, though not particularly limited to, metal oxides such as ITO ($In_2O_3$ doped with $SnO_2$) and ZnO, thin film metals such as Au, Ag and Al and conductive polymers such as polyaniline, polypyrrole, PEDOT/PSS and polythiophene.

As mentioned above, according to this embodiment, a phosphor element which emits light from the second electrode 14 side, namely the reverse side of the substrate can be obtained.

Embodiment 5

Figure 9:
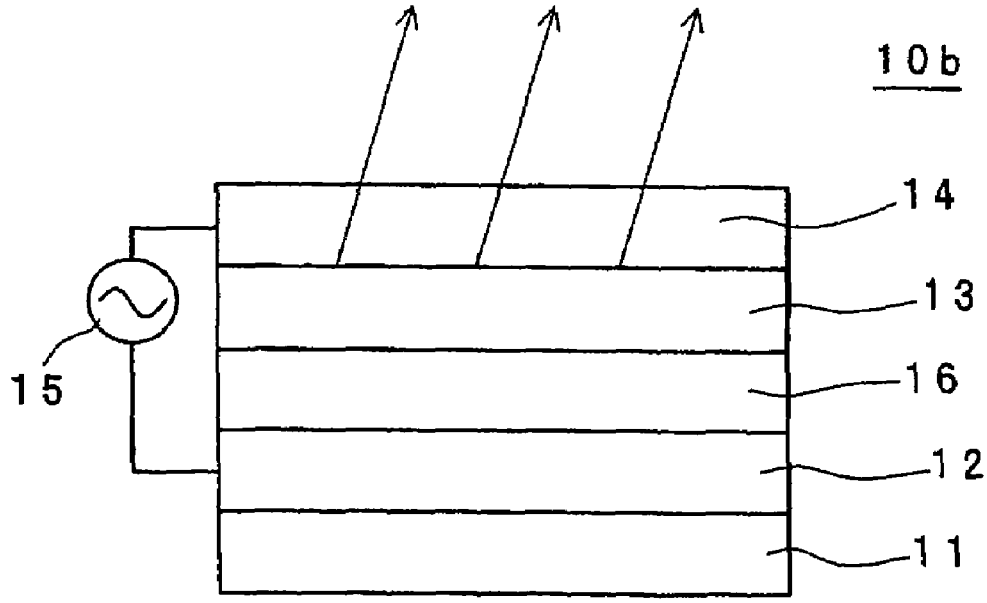
FIG. 9 is a sectional view showing the sectional view of a phosphor element according to an embodiment 5 of the present invention.

FIG. 9 is a sectional view along the line perpendicular to the light emitting surface of the phosphor element 10*b* according to an embodiment 5 of the present invention. As compared with the phosphor element according to the embodiment 4, the phosphor element 10*b* is different from the phosphor element according to the embodiment 4 in the point that an insulation layer 16 is disposed between the first electrode 12 and the phosphor layer 13. Other structures are almost the same as those in the embodiment 4 and therefore explanations of these structures are omitted.

Any material which is an insulation material may be used as the insulation layer 16 without any particular limitation. For example, oxides such as $Al_2O_3$ and $Y_2O_3$, nitrides such as AlN and SiN, perovskite compounds such as $BaTiO_3$, $SrBi_2Ta_2O_9$ and $Bi_4Ti_3O_{12}$, ceramics and organic resins such as polyvinylidene fluoride and polyurea may be used. Also, mixtures of these materials, for example, materials obtained by compounding ceramic particles in an organic binder, and more specifically, materials obtained by dispersing $BaTiO_3$ particles in polyvinylidene fluoride may be used. No particular limitation is imposed on the production method and a method which is well known and is suitable based on the relation of the material of the insulation layer 16 to the substrate 11 and the first electrode 12 may be used. For example, in the case of ceramics, a screen printing method, sol gel method or sputtering method may be used. In the case of organic resins, a spin coating method or screen printing method may be used. Also, after the insulation layer 16 is formed, it may be subjected to heat-treatment such as baking and drying. Moreover, if the insulation layer 16 is made of a light transmittable material, for example, a thin film of $Al_2O_3$ formed by sputtering, a phosphor element that emits light from both sides may be formed.

The phosphor layer 13 may take the same structure as in the embodiments 1 to 3, namely the structure in which the phosphor particles 20 are dispersed in the binder 30 made of an organic material. Also, as the phosphor layer 13, a structure in which only the phosphor particles 20 is used and no organic binder is used may be adopted. In the case of the structure provided with no organic binder as the phosphor layer 13, for example, the phosphor particles 20 may be dispersed in an organic solvent such as ethanol and this dispersion solution is dripped on or applied by spin coating to the insulation layer 16, followed by removing solvents by evaporation to thereby forming the phosphor layer 13. As described above, in the case of a structure provided with no organic binder, there is the possibility that the second electrode 14 penetrates the phosphor layer 13 when forming the second electrode 14 which is the upper electrode. However, because the insulation layer 16 is disposed at the lower part of the phosphor layer 13, the development of a short circuit across the first and second electrodes 12 and 14 can be prevented.

According to this embodiment, as mentioned above, the insulation layer 16 is disposed on the first electrode 12, which ensures that the development of a short circuit across the first and second electrodes 12 and 14 can be prevented even in the case of the phosphor element 10*b* provided with the phosphor layer 13 using no organic binder. Also, the provision of the insulation layer 16 brings about the result that the dielectric strength of the phosphor element 10*b* is outstandingly improved, the reliability of the phosphor element is significantly improved and high voltage can be applied to the phosphor element, which enables a highly bright phosphor element to be obtained.

Embodiment 6

Figure 10:
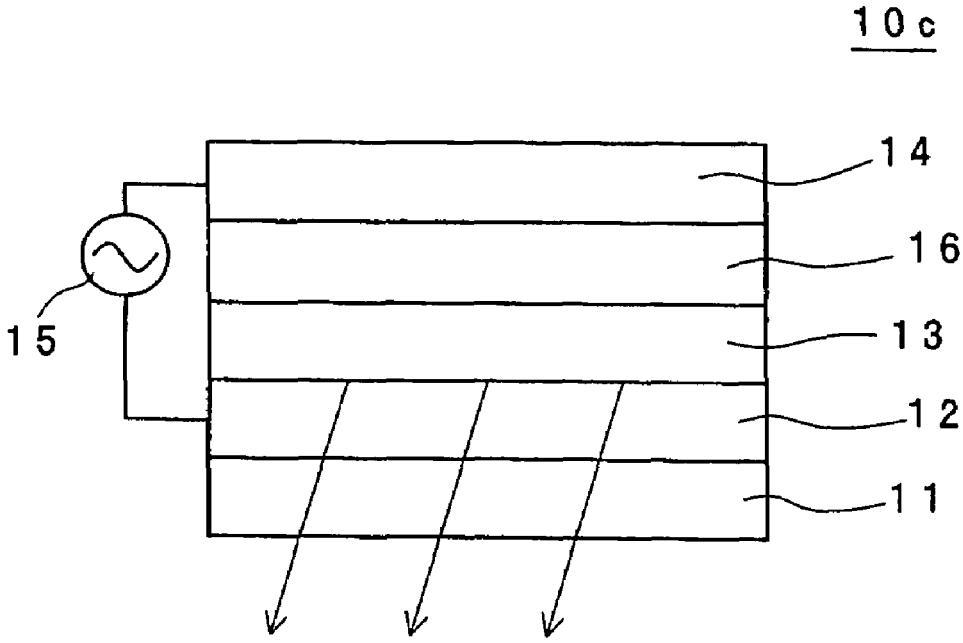
FIG. 10 is a sectional view showing the sectional view of a phosphor element according to an embodiment 6 of the present invention.

FIG. 10 is a sectional view along the line perpendicular to the light emitting surface of the phosphor element 10*c* according to an embodiment 6 of the present invention. As compared with the phosphor element according to the embodiment 1, the phosphor element 10*c* is different from the phosphor element according to the embodiment 1 in the point that an insulation layer 16 is disposed between the phosphor layer 13 and the second electrode 14. The insulation layer 16 and the phosphor layer 13 are the same as those described in the embodiment 5. Other structures are substantially the same as those in the embodiment 1 and therefore explanations of these structures are omitted.

A phosphor element emitting light from both sides, specifically, a phosphor element that can take out light not only from the substrate 11 side but also from the second electrode 14 side by using a light transmittable material for each of the insulation layer 16 and the second electrode 14 can be obtained. Also, the insulation layer 16 is made of a light transmittable material and the second electrode 14 is made of a reflecting material. This makes it possible to reflect the light emitted from the phosphor layer 13 towards the substrate 11 side, with the result that a phosphor element having high phosphor efficacy can be obtained.

According to this embodiment, as mentioned above, a phosphor element provided with a phosphor layer using no organic binder can be obtained in the same manner as in the case of the embodiment 5. Also, the provision of the insulation layer 16 brings about the result that the dielectric strength of the phosphor element is outstandingly improved, the reliability of the phosphor element is significantly improved and high voltage can be applied to the phosphor element, which enables a highly bright phosphor element to be obtained.

Embodiment 7

Figure 11:
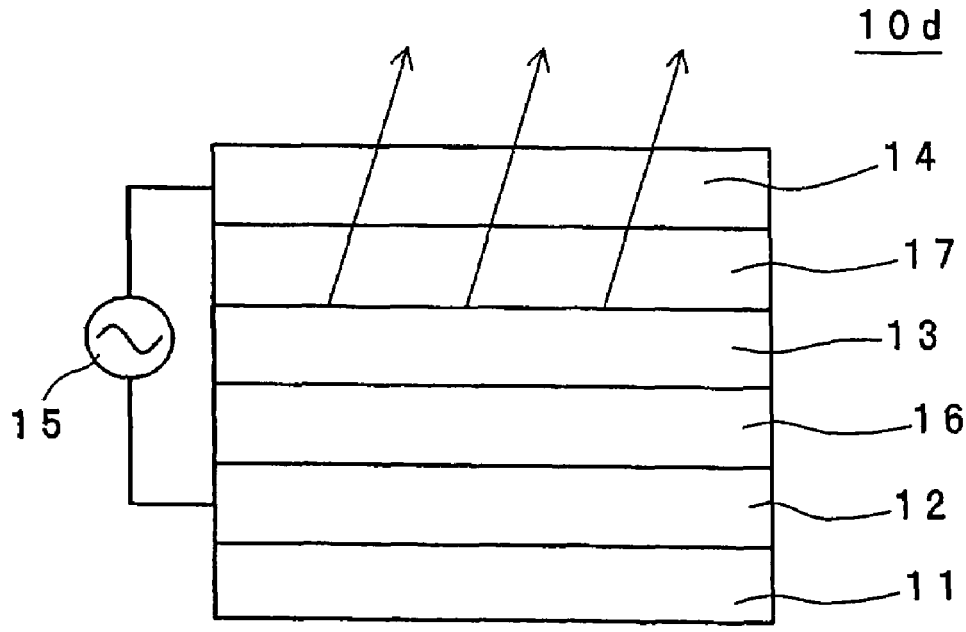
FIG. 11 is a sectional view showing the sectional view of a phosphor element according to an embodiment 7 of the present invention.

FIG. 11 is a sectional view along the line perpendicular to the light emitting surface of the phosphor element 10*d* according to an embodiment 7 of the present invention. As compared with the phosphor element according to the embodiment 5, the phosphor element 10*d* is different from the phosphor element according to the embodiment 5 in the point that a second insulation layer 17 is further disposed between the phosphor layer 13 and the second electrode 14. The substrate 11, the first electrode 12 and the second electrode 14 are the same as those described in the embodiment 4. Also, the first insulation layer 16 is the same as the insulation layer 16 of the embodiment 5. Further, the phosphor layer 13 is the same as in the case of the embodiment 5.

Any material may be used as the second insulation layer 17 without any particular limitation insofar as it is a light transmittable and insulating material. For example, thin film oxides such as $Al_2O_3$ and $Y_2O_3$, thin film nitrides such as AlN and SiN and organic resins such as polyvinylidene fluoride and polyurea may be used. Also, mixtures of these materials, for example, materials obtained by compounding ceramic particles in an organic binder, and more specifically, materials obtained by dispersing $BaTiO_3$ particles in polyvinylidene fluoride may be used though they are deteriorated in light transmittance. No particular limitation is imposed on the production method and a known method may be used. For example, in the case of thin film oxides, a sol gel method or a sputtering method may be used and in the case of organic resins, a spin coating method or screen printing method may be used. Also, after the second insulation layer 17 is formed, it may be subjected to heat-treatment such as baking and drying.

Also, if the substrate 11, the first electrode 12 and the first insulation layer 16 are respectively made of a light transmittable material in the phosphor element 10*d* of this embodiment, the emitted light can be taken out from the substrate 11 side, enabling the production of a phosphor element that emits light from both sides. Alternatively, if either one of the second insulation layer 17 and the second electrode 14 use a light shading material or light reflecting material, and the substrate 11, the first electrode 12 and the first insulation layer 16 are respectively made of a light transmittable material, a phosphor element that emits light from one side, namely the substrate 11 side can be obtained.

According to this embodiment, as mentioned above, the provision of the first and second insulation layers 16, 17 on the upper and lower sides of the phosphor layer 13, respectively, brings about the result that the dielectric strength of the phosphor element can be further improved than that of the phosphor element having one insulation layer, whereby the reliability of the phosphor element is improved and high voltage can be applied to the phosphor element, which enables a highly bright phosphor element to be obtained.

Embodiment 8

Figure 12:
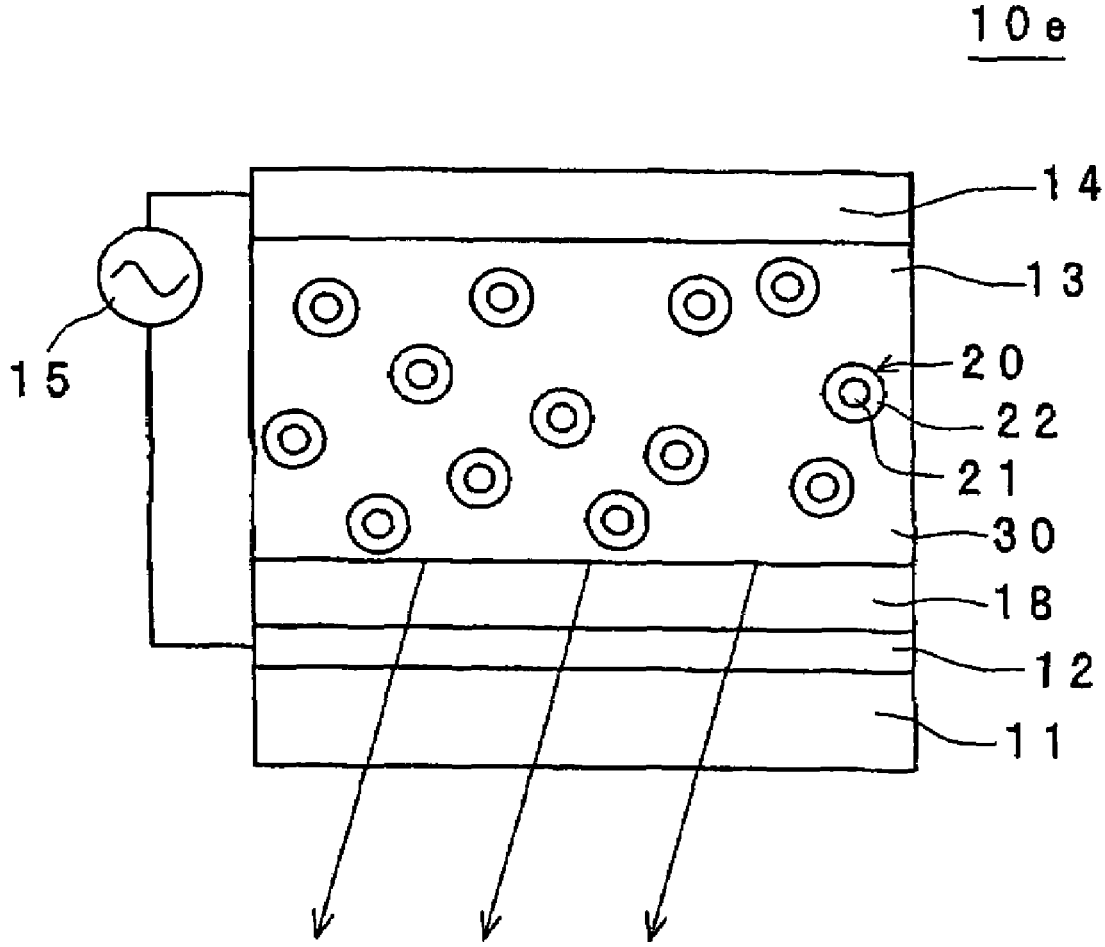
FIG. 12 is a sectional view showing the sectional view of a phosphor element according to an embodiment 8 of the present invention.

FIG. 12 is a sectional view along the line perpendicular to the light emitting surface of the phosphor element 10*e* according to an embodiment 8 of the present invention. As compared with the phosphor element according to the embodiment 1, the phosphor element 10*e* is different from the phosphor element according to the embodiment 1 in the point that a light converting layer 18 is disposed between the first electrode 12 and the phosphor layer 13 as shown in FIG. 12. The color of the light from the phosphor layer 13 can be converted by this light converting layer 18 to take out the light having a color different from that of the emitted light.

Any material may be used as the light converting layer 18 without any particular limitation insofar as it has the ability to convert the color of the light emitted from the phosphor layer 13. Any material may be used as the dye or fluorescent material to be contained in the color converting layer 18 without any particular limitation insofar as it converts the color of the light emitted from the phosphor particles 20. When, for example, a semiconductor having a GaInN structure is used as the phosphor particles 20 to obtain blue light emitted from the phosphor particles 20, the color of the light emitted from the phosphor element can be converted into a pseudo-white color by using the light converting layer 18 containing a YAG fluorescent material. Also, examples of the dye to be contained in the color converting layer 18 include an azo type, anthraquinone type, anthracene type, oxazine type, oxazole type, xanthene type, quinacridone type, cumarin type, cyanine type, stilbene type, terphenyl type, thiazole type, thioindigo type, naphthalimide type, pyridine type, pyrene type, di- or tri-phenylmethane type, butadiene type, phthalocyanine type, fluorene type and perylene type. A xanthene type, cyanine type or the like may be preferably used. Furthermore, two or more types fluorescent materials or dyes may be compounded.

Although the color converting layer 18 is disposed separately from the phosphor layer 13 in this phosphor element, the structure as to the color converting layer 18 is not limited to the above structure, and a dye or a fluorescent material that converts the color of the light emitted from the phosphor particles 20 in the phosphor layer 13 may be contained. Here, any material may be used as the dye or fluorescent material without any particular limitation insofar as it has the ability to convert the color of the light emitted from the phosphor particles 20 in the same manner as above.

It is to be noted that each of the aforementioned embodiment is an example of the phosphor element of the present invention and the structure of the phosphor element is not limited to that of each embodiment. For example, as to the structure of each layer of the phosphor element 10, if the phosphor layer 13 is disposed between a pair of electrodes 12 and 14, light can be emitted. A dielectric layer and the like may be added and the structure of the phosphor element 10 is not limited to that in each of the aforementioned embodiment.

Embodiment 9

Figure 13:
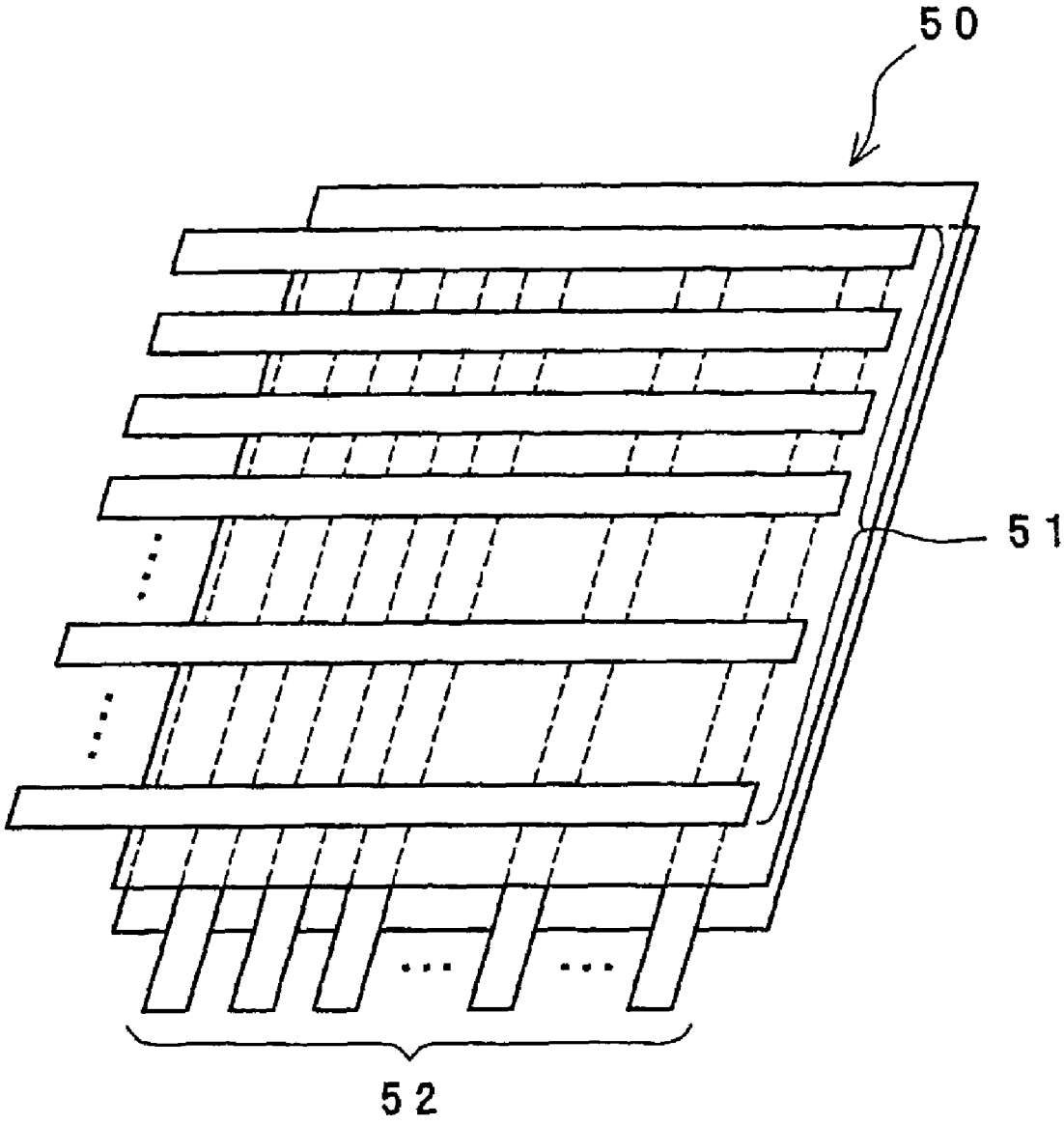
FIG. 13 is a schematic view showing the structure of a display device according to an embodiment 9 of the present invention.

A display device according to an embodiment 9 of the present invention will be explained with reference to FIG. 13. FIG. 13 is a schematic plan view showing a passive matrix display device 50 constituted of a transparent electrode 51 and a counter electrode 52 which are perpendicular to each other in the display device 50. This display device 50 is provided with a phosphor element array in which the plural phosphor elements according to the above embodiment are arranged two-dimensionally. Also, this display device 50 is provided with plural transparent electrodes 51 extending in parallel to a first direction parallel to the surface of the phosphor element array and plural counter electrodes 52 extending in parallel to the surface of the phosphor element array and in parallel to a second direction perpendicular to the first direction. Moreover, in this display device 50, external a.c. voltage is applied across the pair of transparent electrodes 51 and the counter electrode 52 to drive one phosphor element, thereby taking out the emitted light from the front electrode side. According to this display device 50, the above phosphor element is used as the phosphor element of each pixel. This ensures that an inexpensive phosphor element display device is obtained.

Also, in the case of a color display device, the phosphor layers separated by color using fluorescent materials having each color of RGB may be formed. Also, in the case of a color display device in another example, RGB can be displayed using a color filter and/or a color converting filter after the display device is formed with the phosphor layer having one color or two colors. This embodiment shows one example of the display device of the present invention and the structure of the display device of the present invention is not limited to that of this embodiment.

The phosphor element of the present invention is provided with a phosphor layer using phosphor particles, which are provided with a first semiconductor part which is to be the core and a second semiconductor that covers at least a part of the first semiconductor part. This structure makes possible highly reliable light emission at low costs so that the phosphor element of the present invention is useful as phosphor elements for liquid crystal panel back light, surface emission and flat panel displays.

Although the present invention has been described in connection with the preferred embodiments thereof with reference to the accompanying drawings, it is to be noted that various changes and modifications are apparent to those skilled in the art. Such changes and modifications are to be understood as included within the scope of the present invention as defined by the appended claims, unless they depart therefrom.

What is claimed is:

1. A phosphor element comprising:

a pair of electrodes facing each other; and a phosphor layer containing phosphor particles, the phosphor later being supported between the pair of electrodes, wherein the phosphor particles include a first semiconductor part and a second semiconductor part which covers at least a part of the surface of the first semiconductor part, wherein the electric resistance of the second semiconductor part is higher than the electric resistance of the first semiconductor part.

2. The phosphor element according to claim 1, wherein the phosphor particles include a first semiconductor part and a second semiconductor part which covers substantially all of the surface of the first semiconductor part.

3. The phosphor element according to claim 1, the phosphor element comprising at least one insulation layer between either one or both of the pair of electrodes and the phosphor layer.

4. The phosphor element according to claim 1, wherein the phosphor layer is formed by dispersing the phosphor particles in a binder.

5. The phosphor element according to claim 1, the phosphor element further comprising a first insulation layer and a second insulation layer between the phosphor layer and each of the pair of electrodes, wherein the phosphor layer is supported by the first insulation layer and the second insulation layer.

6. The phosphor element according to claim 1, wherein the first semiconductor part and the second semiconductor part have semiconductor structures having conductive types different from each other.

7. The phosphor element according to claim 6, wherein the first semiconductor part has a n-type semiconductor structure and the second semiconductor part has a p-type semiconductor structure.

8. The phosphor element according to claim 6, wherein the first semiconductor part has a p-type semiconductor structure and the second semiconductor part has a n-type semiconductor structure.

9. The phosphor element according to claim 1, wherein the first semiconductor part and the second semiconductor part are respectively a compound semiconductor.

10. The phosphor element according to claim 9, wherein the first semiconductor part and the second semiconductor part are respectively a XIII group-XV group compound semiconductor or a XII group-XVI group compound semiconductor.

11. The phosphor element according to claim 1, wherein each outermost surface of the phosphor particles is coated with a protective layer.

12. The phosphor element according to claim 1, the phosphor element further comprising a substrate supporting at least one electrode among the pair of electrodes.

13. The phosphor element according to claim 1, the element further comprising a color converting means of converting the color emitted from the phosphor particles.

14. The phosphor element according to claim 13, wherein the color converting means is a dye or a fluorescent material disposed in the phosphor layer.

15. The phosphor element according to claim 13, wherein the color converting means is a color converting layer disposed on a light emitting surface of the phosphor layer.

16. A phosphor element comprising:

a pair of electrodes facing each other; and a phosphor layer containing phosphor particles, the phosphor layer being supported between the pair of electrodes, wherein the phosphor particles include a first semiconductor part and a second semiconductor part which covers at least a part of the surface of the first semiconductor part, wherein each outermost surface of the phosphor particles is coated with a protective layer, and wherein the protective layer has a higher electric resistance than the second semiconductor part.

17. A phosphor element comprising:

a pair of electrodes facing each other; and a phosphor layer containing phosphor particles, the phosphor layer being supported between the pair of electrodes, wherein the phosphor particles include a first semiconductor part as the core, a second semiconductor part as the outermost part of the phosphor particles and a third semiconductor part which is disposed between the first semiconductor part and the second semiconductor part and covers substantially all surface of the first semiconductor part, wherein the band gap energy of the third semiconductor part is lower than the bandgap energy of at least one of the first semiconductor part and the second semiconductor part.

18. The phosphor element according to claim 17, the phosphor element further comprising a first insulation layer and a second insulation layer between the phosphor layer and each of the pair of electrodes, wherein the phosphor layer is supported by the first insulation layer and the second insulation layer.

19. The phosphor element according to claim 17, the phosphor element further comprising a substrate supporting at least one electrode among the pair of electrodes.

20. The phosphor element according to claim 17, wherein the electric resistance of the second semiconductor part is higher than the electric resistance of the first semiconductor part.

21. The phosphor element according to claim 17, wherein the phosphor layer is formed by dispersing the phosphor particles in a binder.

22. The phosphor element according to claim 21, wherein the electric resistance of the binder is higher than the electric resistance of the second semiconductor part.

23. The phosphor element according to claim 17, wherein the first semiconductor part and the second semiconductor part have semiconductor structures having conductive types different from each other.

24. The phosphor element according to claim 23, wherein the first semiconductor part has a n-type semiconductor structure and the second semiconductor part has a p-type semiconductor structure.

25. The phosphor element according to claim 23, wherein the first semiconductor part has a p-type semiconductor structure and the second semiconductor part has a n-type semiconductor structure.

26. The phosphor element according to claim 17, wherein the first semiconductor part and the second semiconductor part are respectively a compound semiconductor.

27. The phosphor element according to claim 26, wherein the first semiconductor part and the second semiconductor part are respectively a XIII group-XV group compound semiconductor or a XII group-XVI group compound semiconductor.

28. The phosphor element according to claim 17, wherein each outermost surface of the phosphor particles is coated with a protective layer.

29. The phosphor element according to claim 28, wherein the protective layer has a higher electric resistance than the second semiconductor part.

30. The phosphor element according to claim 17, the element further comprising a color converting means of converting the color emitted from the phosphor particles.

31. The phosphor element according to claim 30, wherein the color converting means is a dye or a fluorescent material disposed in the phosphor layer.

32. The phosphor element according to claim 30, wherein the color converting means is a color converting layer disposed on a light emitting surface of the phosphor layer.

33. The phosphor element according to claim 17, the phosphor element comprising at least one insulation layer between either one or both of the pair of electrodes and the phosphor layer.

34. A phosphor element comprising:

a pair of electrodes facing each other; and a phosphor layer containing phosphor particles, the phosphor layer being supported between the pair of electrodes, wherein the phosphor particles include a first semiconductor part and a second semiconductor part which covers at least a part of the surface of the first semiconductor part, wherein the phosphor layer is formed by dispersing the phosphor particles in a binder, and wherein the electric resistance of the binder is higher than the electric resistance of the second semiconductor part.

35. The phosphor element according to claim 34, wherein the electric resistance of the second semiconductor part is higher than the electric resistance of the first semiconductor part.

36. The phosphor element according to claim 34, wherein each outermost surface of the phosphor particles is coated with a protective layer.

37. The phosphor element according to claim 36, wherein the protective layer has a higher electric resistance than the second semiconductor part.

38. The phosphor element according to claim 34, wherein the phosphor particles include a first semiconductor part and a second semiconductor part which covers substantially all of the surface of the first semiconductor part.

39. The phosphor element according to claim 34, wherein the first semiconductor part and the second semiconductor part have semiconductor structures having conductive types different from each other.

40. The phosphor element according to claim 39, wherein the first semiconductor part has a n-type semiconductor structure and the second semiconductor part has a p-type semiconductor structure.

41. The phosphor element according to claim 39, wherein the first semiconductor part has a p-type semiconductor structure and the second semiconductor part has a n-type semiconductor structure.

42. The phosphor element according to claim 34, wherein the first semiconductor part and the second semiconductor part are respectively a compound semiconductor.

43. The phosphor element according to claim 42, wherein the first semiconductor part and the second semiconductor part are respectively a XIII group-XV group compound semiconductor or a XII group-XVI group compound semiconductor.

44. The phosphor element according to claim 34, the element further comprising a color converting means of converting the color emitted from the phosphor particles.

45. The phosphor element according to claim 44, wherein the color converting means is a dye or a fluorescent material disposed in the phosphor layer.

46. The phosphor element according to claim 44, wherein the color converting means is a color converting layer disposed on a light emitting surface of the phosphor layer.

47. The phosphor element according to claim 34, the phosphor element comprising at least one insulation layer between either one or both of the pair of electrodes and the phosphor layer.

48. The phosphor element according to claim 34, the phosphor element further comprising a first insulation layer and a second insulation layer between the phosphor layer and each of the pair of electrodes, wherein the phosphor layer is supported by the first insulation layer and the second insulation layer.

49. The phosphor element according to claim 34, the phosphor element further comprising a substrate supporting at least one electrode among the pair of electrodes.

* * * * *

UNITED STATES PATENT AND TRADEMARK OFFICE

CERTIFICATE OF CORRECTION

PATENT NO. : 7,638,938 B2
APPLICATION NO. : 11/253794
DATED : December 29, 2009
INVENTOR(S) : Aoyama et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1075 days.

Signed and Sealed this

Ninth Day of November, 2010

David J. Kappos

David J. Kappos
*Director of the United States Patent and Trademark Office*